US005829599A

United States Patent [19]

Woodgate

[11] Patent Number: 5,829,599

[45] Date of Patent: Nov. 3, 1998

[54] SCREENING APPARATUS

[75] Inventor: Raymond Maxwell Woodgate, Melton South, Australia

[73] Assignee: Lettela Proprietary Limited, Victoria, Australia

[21] Appl. No.: 700,149

[22] Filed: Aug. 20, 1996

[30] Foreign Application Priority Data

Aug. 31, 1995 [AU] Australia ..... PN5143

[51] Int. Cl.[6] ..... B07B 1/49

[52] U.S. Cl. ..... 209/399; 209/405; 209/408

[58] Field of Search ..... 209/399, 405, 209/403, 408, 412

[56] References Cited

U.S. PATENT DOCUMENTS

| | | | |
|---|---|---|---|
| 721,875 | 3/1903 | Farnsworth . | |
| 766,150 | 7/1904 | Lovejoy . | |
| 918,261 | 4/1909 | Bayley . | |
| 2,345,364 | 3/1944 | Spafford . | |
| 4,141,821 | 2/1979 | Wolff | 209/405 |
| 4,670,136 | 6/1987 | Schmidt et al. | 209/405 X |
| 4,871,288 | 10/1989 | Schmidt et al. | 209/405 X |
| 4,882,044 | 11/1989 | Freissle | 209/405 X |
| 4,909,929 | 3/1990 | Tabor . | |
| 5,112,475 | 5/1992 | Henry, Jr. . | |

FOREIGN PATENT DOCUMENTS

| | | | |
|---|---|---|---|
| A-47137/89 | 8/1990 | Australia . | |
| A-46502/89 | 12/1990 | Australia . | |
| 167999 | 1/1986 | European Pat. Off. | 209/399 |
| 0 470 422 A2 | 12/1992 | European Pat. Off. . | |
| 5092 | 8/1975 | South Africa | 209/399 |
| 435328 | 9/1935 | United Kingdom . | |

OTHER PUBLICATIONS

Advertisement—"How Fasts Can you Change Your Screen Decks?", Conn Weld Industries, Inc., Princeton, West Virginia; published in Coal, Sep. 1991.

*Primary Examiner*—Boris Milef

*Attorney, Agent, or Firm*—Merchant, Gould, Smith, Edell, Welter & Schmidt, P.A.

[57] ABSTRACT

Screening apparatus for screening, separating or grading materials such as ores or the like includes a screen deck frame (3) which supports at least two adjacent screen panels (2). Each screen panel (2) includes a longitudinally extending arm (20) connected to a side face (19) of the panel by a cantilever section (22). The adjacent screen panels (2) are secured in position by virtue of the arms (20) being clamped between a rail type fixing member (4), which is fixed to the screen deck frame by bolts (9–11), and a rail type retaining member (5). Retaining member 5 has a cover portion (27) that overlies the joint between the adjacent screen panels to prevent the entry of ore fines into the joint. Embodiments are described wherein the arms may extend upwardly or downwardly, and wherein the upper surface of the cover portion of the retaining member may lie flush with the upper surface of the screen panels.

18 Claims, 2 Drawing Sheets

SCREENING APPARATUS

BACKGROUND OF INVENTION

This invention relates generally to apparatus for screening, separating or grading materials and in particular to the fixing of screen panels to a support frame of such apparatus. The apparatus is applicable for screening, separating and grading ores or other materials, and it will be convenient to hereinafter describe the invention in relation to this exemplary application. It is to be understood, however, that the invention is not limited to such apparatus.

A variety of systems have been developed for fixing screen panels to a support frame whereby individual panels can be easily and rapidly removed and replaced when worn. One system used for fixing adjacent screen panels along opposed side edge regions to a support frame is disclosed in Australian patent 654091. The system of this patent provides an elongate U-shaped fixing member for securing to the support frame so as to extend longitudinally between side edge regions of adjacent screen panels. The fixing member has a pair of connection portions, with connection elements being provided along the outer side surfaces of the connection portions and the side edge faces of the screen panels. The connection elements of each connection portion and an associated screen panel interengage to hold the screen panels in position on the support frame. The connection portions are inwardly deflectable away from the side edge faces in order to disengage the connection elements and disconnect the screen panels from the fixing member. A retaining member is provided for extending along the fixing member in engagement with the connection portions to resist their inadvertent deflection, and thus maintain engagement between the connection elements.

SUMMARY OF THE INVENTION

It is an object of the present invention to provide screening apparatus and screen panels for use therein having alternative screen panel fixation means that seeks to improve the securement of screen panels in the apparatus.

Accordingly, the present invention provides screening apparatus for screening, separating or grading materials such as, for example, ores or the like, the apparatus including:

a screen deck frame, at least two adjacent screen panels, an elongate fixing member and an elongate retaining member, wherein the elongate fixing member is fixed to the screen deck frame and extends along and between facing side edge faces of the adjacent screen panels, wherein each of the facing side edge faces of the adjacent screen panels includes a longitudinally extending connection portion for engaging an adjacent portion of the fixing member, wherein the retaining member is engaged with the adjacent screen panels so as to clamp each connection portion thereof between the fixing member and the retaining member such that each screen panel is secured to the frame.

The invention also provides a screen panel for use in a screening apparatus wherein an elongate side edge face of the panel includes a longitudinally extending connection portion for clamping between an elongate fixing member and an elongate retaining member, and wherein the screen panel is such that a said retaining member is engageable therewith to effect the said clamping of the said connection portion.

The invention is described herein with reference to the apparatus in a normal use orientation on a horizontally extending screen deck frame, and terms such as "above", "upward", "downward", "upper" and "lower" should be construed in the light of this orientation. However, it is to be understood that other orientations may be equally possible and that consequential changes in terms such as those above may be required in the light of those other orientations for a proper and complete understanding of the invention.

Screening apparatus of the type with which the invention is concerned is of any suitable construction well known to those skilled in the art. In that regard, the apparatus will include a screen deck frame typically constructed of support members for providing underlying support for a screen deck. An array of screen panels are fixed to the deck frame to form a continuous screen deck. Each screen panel is typically flat, and square or rectangular in plan shape, with an upper screening surface for receiving ore to be screened and a lower bearing surface that may bear on the underlying support members. Apertures extend through the screen panels between the screening and bearing surfaces to provide for ore screening and separation.

Preferably the longitudinally extending connection portion of a side edge face of a screen panel extends along the entire length of the side edge face and has the form of an arm that is connected to the side edge face by a cantilever section. Preferably the arm is resiliently deflectable relative to the screen panel. In one embodiment the arm may depend downwardly from the cantilever section such that a downwardly opening connection channel or socket is defined by a side face thereof, the side edge face of the screen panel and lower surface of the cantilever section. In another embodiment the arm may be orientated upwardly from the cantilever section such that an upwardly opening connection channel or socket is defined by a side face thereof, the side edge face of the screen panel and upper surface of the cantilever section. In either of the above embodiments, the cantilever section may be connected to or extend from the side edge face of the screen panel adjacent its upper surface or adjacent its lower surface or at an intermediate position.

Preferably the connection portion includes at least one connection element for releasably interengaging a complementary connection element on a fixing member or a retaining member to assist in securing the parts together. For a connection portion that is in the form of an arm, the connection element may be a rib that extends along the arm, alternatively it may be a longitudinal groove in the arm. Preferably a plurality of such connection elements are provided. It is to be appreciated that a fixing member or a retaining member for use with a screen panel having one or more rib or groove-type connection elements, or both, will include complementary grooves and/or ribs for interengagement with the connection elements of the screen panel.

It will be appreciated that when two similar screen panels are located adjacent each other, the connection portion on one side edge face of one panel is a "mirror image" of the connection portion on the opposed side edge face of the other screen panel. Thus, the juxtaposition of two screen panels having connection portions in the form of arms effectively forms a connection channel or socket between the two screen panels. For an embodiment where the arms depend downwardly from a cantilever section, this connection channel or socket, as defined by the outer facing surfaces of the arms, can receive a suitably shaped downwardly depending elongate plug portion of the retaining member. For an embodiment where the arms extend upwardly from a cantilever section, the connection channel or socket, as defined by the outer facing surfaces of the arms, can receive a suitably shaped upwardly directed elongate plug portion of the fixing member. In both embodiments, therefore, effectively three connection channels or sockets are involved in the fixing of the screen panels to a support frame, one which is formed by the juxtapositioning of the screen panels, and one on either side thereof which exists in each screen panel (by virtue of the spacing of the arm from the side edge face). The location of suitably shaped plug portions of the fixing member and the retaining member in the connection sockets serves to clamp each arm therebetween.

BRIEF DESCRIPTION OF THE DRAWINGS

Embodiments of the invention will now be described, by way of example only, with reference to the accompanying drawings. The specific form and arrangement of the various features shown in the drawings is not to be understood as limiting on the invention, the scope of which is to be determined according to the generality of the preceding description. It is also to be understood that the specific form of a feature of the invention as shown in one embodiment may be applied to or interchanged for the specific form of a corresponding feature as shown in another embodiment.

In the drawings.

DETAILED DESCRIPTION OF PREFERRED EMBODIMENTS

Figure 1:
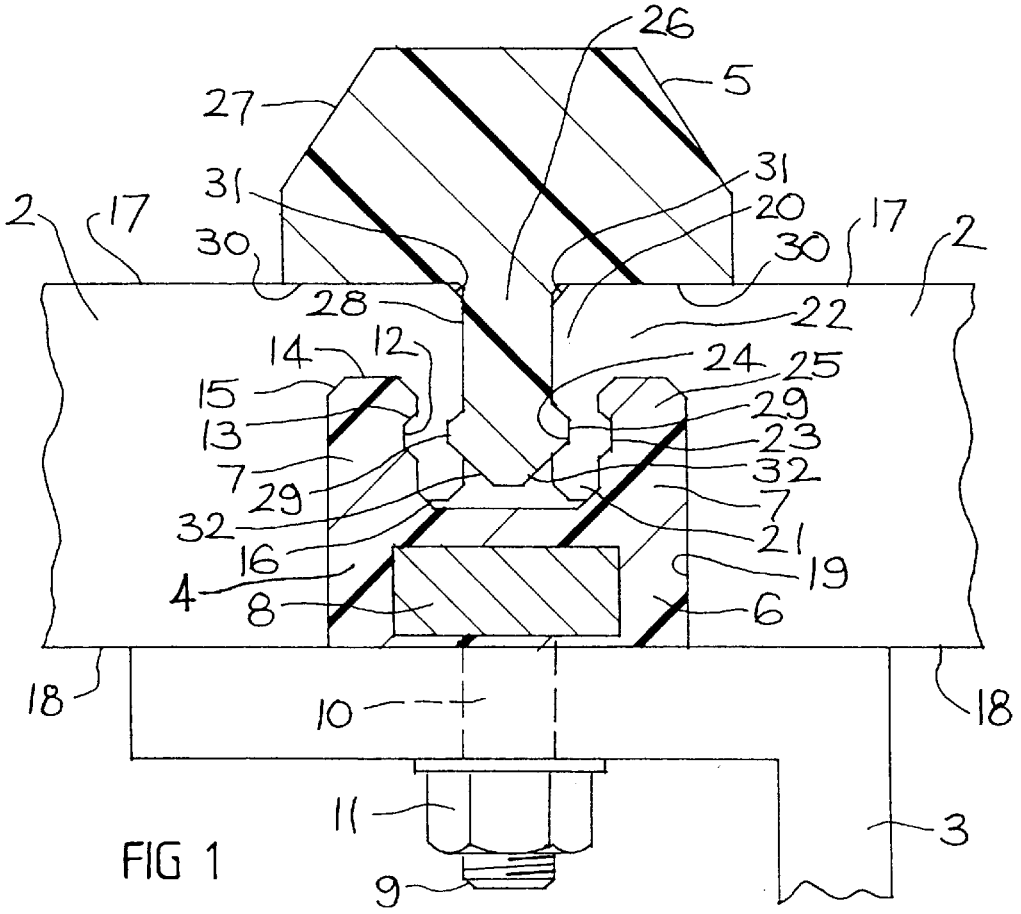
FIG. 1 is a cross-sectional side view of portion of an ore screening apparatus illustrating a first embodiment of the invention.

FIG. 1 illustrates adjacent screen panels 2,2 of an ore screening apparatus releasably secured to a support member 3 of a screen deck frame by a fixing member 4 and a retaining member 5. A full description of an ore screening apparatus of the type with which the invention is concerned is given in the applicant's previous Australian patent No. 654091, the disclosure of which is to be taken as incorporated herein by this cross reference. Reference should be made to this previous patent for an understanding of the context of the invention. It is to be understood that whereas a fixing member will normally be at least as extensive longitudinally as the screen panels, a retaining member may be of lesser extent.

In the embodiment illustrated in FIG. 1, fixing member 4 is in the form of a rail having a base portion 6 and opposed laterally spaced upstanding upper portions 7, such that the rail 4 has a generally U-shaped cross-sectional profile. Fixing member 4 may be cast or moulded in one piece from a resilient plastics material, such as polyurethane, and may be internally reinforced with one or more metal elements, such as a steel plate as shown at 8. It is to be understood that alternative materials and methods of production may be used for member 4.

Fixing rail 4 may be mounted on frame support member 3 through any suitable arrangement. In this embodiment, base portion 6 has depending bolts 9 moulded therein (only one of which is depicted in the FIG. 1 view) which pass through apertures 10 in support member 3. Nuts 11 on bolts 9 serve to fix rail 4 in position.

Each upper portion 7 of fixing rail 4 includes a connection element in the form of a longitudinally extending groove 12 in the inner facing face of portion 7 (note: as the upper portions 7 are similar to each other, reference numerals are indicated on only one such portion so as not to clutter the figure). The sides of groove 12 may be angled as indicated by reference 13. Also the junctions that the top facing surface 14 on each upper portion 7 forms with the respective side surfaces of a portion 7 may be chamfered as indicated at 15. Furthermore, the junction of each inner facing surface of top portions 7 with the upper facing surface of base portion 6 may be angled as indicated at 16.

Each screen panel 2 is typically flat and square or rectangular in plan shape, with an upper screening surface 17 for screening ore or other material to be screened and a lower bearing surface 18 that bears on support members such as 3. Apertures (not shown) extend through the screen panels 2 between the screening and bearing surfaces 17 and 18 to provide for ore screening and separation. Each screen panel has at least one side edge face 19 that includes a longitudinally extending connection portion 20.

In the FIG. 1 embodiment screen panels 2 are cast or moulded from plastics material such as polyurethane, and may be internally reinforced with one or more metal elements, such as steel bars (not shown). It is to be understood that alternative materials and methods of production may be equally suitable.

Each connection portion 20 of the side edge faces 19 of the two panels 2 shown in FIG. 1 includes a downwardly depending arm section 21 that is connected to side edge face 19 by a cantilever section 22. It will be appreciated that in the FIG. 1 embodiment arm 21 of a panel 2 is resiliently deflectable relative to side edge face 19 of that panel 2. Arm 21 includes connection elements in the form of a rib 23 on its inner side face and a complementary groove 24 on its outer side face opposite rib 23. The arrangement of arm 22 on a screen panel 2 forms a downwardly opening connection channel 25, which channel is defined by the inner side face of arm 21, bottom surface of cantilever section 22 and side edge face 19 of screen panel 2. Channel 25 is dimensioned to receive an upper portion 7 of fixing rail 4, which upper portion 7 may be an interfering fit within a socket 25, with connection rib 23 on arm 21 seating within connection groove 12 on portion 7. In effect, each upper portion 7 of a fixing rail 4 forms a plug portion for a connection channel 25.

When two screen panels 2 are located adjacent each other as depicted in FIG. 1 such that upper (plug) portions 7 of rail 4 are engaged in channels 25, the "mirror image" connection portions of each (comprising an arm 21 and cantilever section 22) effectively form another connection channel 26 between the two screen panels.

Elongate retaining member 5 as shown in FIG. 1 is in the form of a rail and has a cover portion 27 and a downwardly depending plug portion 28. Retaining rail 5 may be cast or moulded in one piece from a resiliently flexible plastics material, such as polyurethane, and may be internally reinforced with one or more metal elements, such as steel bars (not shown). It is to be understood that alternative materials and methods of construction may be used for member 5.

Plug portion 28 of rail 5 is sized such that it will interferingly fit within channel 26 between arms 21 of screen panels 2 (when the panels are engaged with the fixing rail 4) and it includes connecting elements in the form of ribs 29 which are complementarily shaped to seat within grooves 24 of arms 21. These connecting elements, additionally to the interference fit of plug portion 28 within channel 26, aid in the retention of retaining strip 5 in position during apparatus operation. In the FIG. 1 embodiment, cover portion 27 includes a pair of downwardly facing surfaces 30 for downward bearing engagement upon upper screening surfaces 17 of screen panels 2 such that cover portion 27 seats over the joint between the screen panels to prevent ore fines from entering the joint. Retaining member 5 is inserted into connecting channel 26 after connecting arms 21 of screen panels 2 are engaged with the adjacent upper portions 7 of fixing rail 4. Chamfers 31 may be provided at the junction of the upper screening surfaces 17 of panels 2 with the outer facing surfaces of arms 21 to allow plug portion 28 to be more easily inserted into channel 26. Furthermore, plug portion 28 may include angled surfaces 32 at its leading end (thereby effectively defining an arrowhead shape) for the same purpose. Thus the retaining rail 5 is engaged with screen panels 2 (via plug 28 and surfaces 30) and the fit of plug portion 28 within channel 26 serves to clamp the connection arms 21 of panels 2 between the said plug portion 28 and the upper portions 7 of rail 4, that is, the connection portions (comprising arms 21) of the screen panels 2 are clamped between the fixing member 4 and retaining member 5 thereby securing the screen panels 2 to the support member 3 of the screen deck frame.

Figure 2:
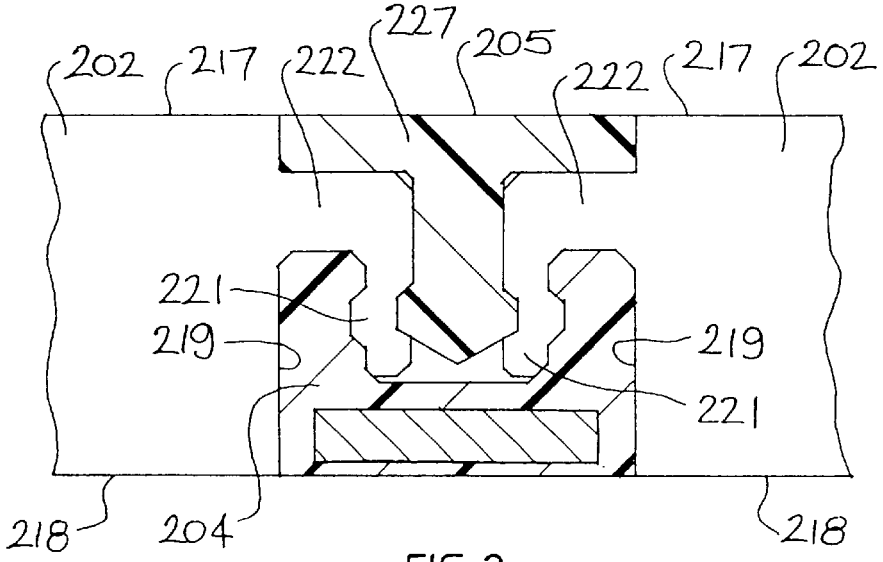
FIG. 2 is a view similar to FIG. 1 illustrating a second embodiment of the invention.

FIG. 2 shows another embodiment of the invention wherein features that correspond with features that have been described with reference to the FIG. 1 embodiment are similarly labelled, except that the labelling is in the number series 200–299 and not 1–99 as in FIG. 1. The FIG. 2 embodiment does not illustrate a support member of a screen deck frame to which fixing member 204 is fixed. However it is to be understood that the fixing member 204 is fixable to such a support member in like manner to that illustrated in FIG. 1 or in some other suitable manner. Similarly, the fixing members shown in the FIGS. 3 and 4 embodiments are to be understood as being fixable to support members of screen frames.

The FIG. 2 embodiment differs from FIG. 1 in that cantilever sections 222, from which connection arms 221 depend, extend from side edge faces 219 of screen panels 202 intermediate the top screening surface 217 and bottom bearing surface 218 of panels 202. Also cover portion 227 of retaining member 205 is sized to engagingly seat within the recessed area which results from this positioning of the cantilever sections 222 such that its upper surface lies flush with the upper screening surfaces 217. Otherwise this embodiment is generally the same as that of FIG. 1.

Figure 3:
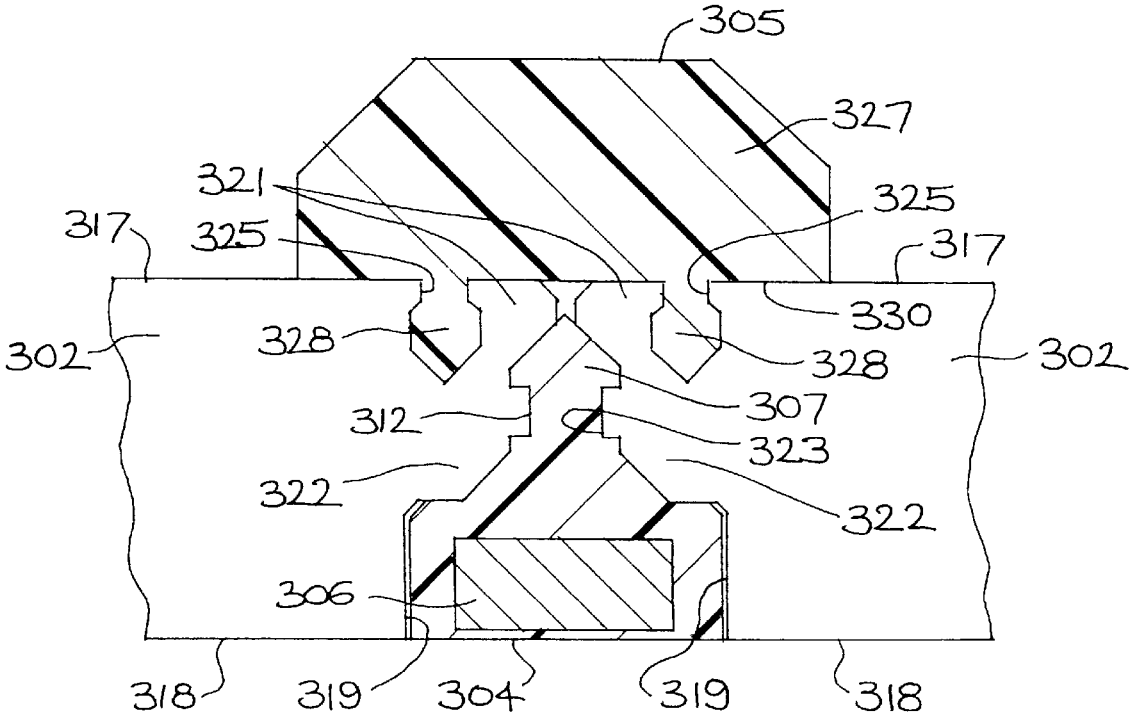
FIG. 3 is a view similar to FIG. 1 illustrating a third embodiment of the invention.

FIG. 3 shows a still further embodiment of the invention wherein features that are similar to features that have been described with reference to the FIG. 1 embodiment are correspondingly labelled, except that the labelling is in the number series 300–399 and not 1–99 as in FIG. 1.

Thus FIG. 3 illustrates a fixing member in the form of a rail 304, screen panels 302 and retaining member in the form of a rail 305. Panels 302 and rails 304 and 305 may be made of a resiliently flexible plastics material, such as polyurethane, and include reinforcing members (not shown) as in the FIG. 1 embodiment.

Screen panels 302 each include a connection portion in the form of an upwardly orientated arm 321 which is connected to side edge face 319 by a cantilever section 322. Fixing rail 304 includes a base portion 306 and a single upstanding upper portion 307 (rather than two upstanding upper portions as in the FIGS. 1 and 2 embodiments). Upstanding portion 307 effectively provides an elongate plug portion for engaging a connection channel that is formed by the adjacently positioned screen panels. The connection arms 321 of screen panels 302 and upper (plug) portion 307 of rail 304 may include complementary connection elements in the form of, respectively, ribs 323 and grooves 312.

Retaining rail 305 includes a cover portion 327 and two (rather than one as in the FIG. 1 or FIG. 2 embodiments) downwardly depending plug portions 328. Plug portions 328 are an interference fit within an upwardly opening connection channel 325 in each screen panel 302 that is formed by the spacing of arm 321 from side face 319. Connection elements in the form of complementary profiled ribs and grooves are provided within connection sockets 325 and plug portions 328 (such that plug portions 328 are thereby arrow-shaped in cross section) to ensure retentive engagement of the plug portions 328 within connection sockets 325, and thereby downward bearing engagement of lower surfaces 330 of cover portion 327 on upper screening surfaces 317 of screen panels 302. It will be evident from an inspection of FIG. 3 in the light of the description of the FIG. 1 embodiment that the screen panels 302 are secured to a support frame by means of arms 321 being clamped between the fixing rail 304 and retaining rail 305.

Figure 4:
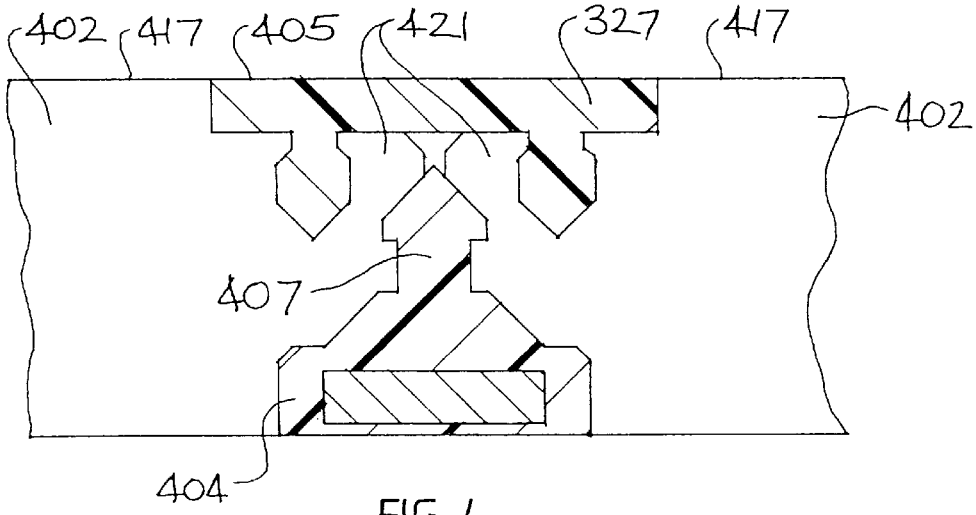
FIG. 4 is a view similar to FIG. 1 illustrating a fourth embodiment of the invention.

FIG. 4 shows another embodiment of the invention wherein features that are similar to features that have been described with reference to the FIG. 1 embodiment are correspondingly labelled, except that the labelling is in the number series 400–499 and not 1–99 as in FIG. 1. The FIG. 4 embodiment is similar to the FIG. 3 embodiment in that the connection portions of screen panels 402 are upwardly orientated arms 421. Generally the FIG. 4 embodiment differs from the FIG. 3 embodiment by the provision of a recessed area within which the cover portion 327 of retaining member 405 engagingly seats such that its upper surface lies flush with upper screening surfaces 417 of screen panels 402. The functioning of this embodiment will be evident from an inspection of FIG. 4 in the context of the preceding description of the FIGS. 1 to 3 embodiments.

The fixing system of the present invention provides for simple and rapid removal and replacement of individual screen panels from ore screening apparatus. In particular, such removal and replacement can be achieved by unskilled labour using a minimum of ordinary tools. Moreover screen panel removal and replacement with this fixing system ensures a minimum amount of apparatus "downtime", thereby providing the opportunity of increased apparatus productivity.

The invention described herein is susceptible to variations, modifications and/or additions other than those specifically described and it is to be understood that the invention includes all such variations, modifications and/or additions which fall within the spirit and scope of the above description. In particular, it is to be understood that an apparatus according to the invention may include other features, such as for example dams, as are described in Patent No., 654091.

I claim:

1. Screening apparatus for screening, separating or grading materials, including a screen deck frame, at least two adjacent screen panels, an elongate fixing member and an elongate retaining member, wherein the elongate fixing member is fixed to the screen deck frame and extends along and between facing side edge faces of the adjacent screen panels, wherein each of the facing side edge faces of the adjacent screen panels includes a longitudinally extending connection portion for engaging an adjacent portion of the fixing member, wherein each connection portion comprises a connection arm which is connected to the side edge face by a cantilever section, the connection arm extending from the cantilever section in a direction that is substantially transverse of the elongate fixing member, and wherein the retaining member is engaged with the adjacent screen panels so as to clamp each connection portion thereof between the fixing member and the retaining member such that each screen panel is secured to the frame.

2. Screening apparatus as claimed in claim 1 wherein the longitudinally extending connection portion of the facing side edge face of each adjacent screen panel extends along the entire length of the side edge face.

3. Screening apparatus as claimed in claim 1 wherein the connection arm of each screen panel is resiliently deflectable relative to the screen panel.

4. Screening apparatus as claimed in claim 3 wherein the arm of each screen panel is orientated upwardly from the cantilever section such that an upwardly opening connection channel is defined by a side face of the arm, the side edge face of the screen panel and upper surface of the cantilever section.

5. Screening apparatus as claimed in claim 4 wherein the cantilever section of the connection portion of each screen panel is connected to the side edge face of the screen panel adjacent the lower surface of the screen panel.

6. Screening apparatus as claimed in claim 4 wherein the cantilever section of the connection portion of each screen panel is connected to the side edge face of the screen panel at an intermediate position between the upper and lower surfaces of the screen panel.

7. Screening apparatus as claimed in claim 4 wherein the retaining member includes two substantially parallel downwardly depending plug portions which are received within the upwardly opening connection channels of the adjacent screen panels, and wherein the fixing member includes an upwardly directed plug portion.

8. Screening apparatus as claimed in claim 3 wherein the connection arm of each screen panel is orientated downwardly from the cantilever section such that a downwardly opening connection channel is defined by a side face of the arm, the side edge face of the screen panel and lower surface of the cantilever section.

9. Screening apparatus as claimed in claim 8 wherein the cantilever section of the connection portion of each screen panel is connected to the side edge face of the screen panel adjacent the upper surface of the screen panel.

10. Screening apparatus as claimed in claim 8 wherein the cantilever section of the connection portion of each screen panel is connected to the side edge face of the screen panel at an intermediate position between the upper and lower surfaces of the screen panel.

11. Screening apparatus as claimed in claim 8 wherein the adjacent screen panels are spaced apart to provide a longitudinally extending connection channel and wherein the retaining member includes a downwardly depending plug portion which is received in this connection channel provided by said spaced apart adjacent screen panels, and wherein the fixing member includes two substantially parallel upstanding plug portions which are received within the downwardly opening connection channels of the adjacent screen panels.

12. Screening apparatus as claimed in claim 3 wherein the longitudinally extending connection portion of the side edge face of each screen panel includes at least one connection element for releasably interengaging a complementary connection element on the fixing member or the retaining member.

13. Screening apparatus as claimed in claim 12 wherein the connection element of said connection portion is on the connection arm and comprises a rib that extends along the connection arm and said complementary connection element comprises a complementary shaped groove in a facing surface of the fixing member or the retaining member.

14. Screening apparatus as claimed in claim 12 wherein the at least one complementary connection element of said connection portion is on the connection arm of each screen panel and includes at least one longitudinal groove and said complementary connection element comprises a complementary shaped rib on a facing surface of the fixing member or the retaining member.

15. Screening apparatus as claimed in claim 1 wherein the retaining member includes a cover portion which overlies the facing side edge faces of the adjacent screen panels to prevent ore fines from entering between said facing side edge faces.

16. Screening apparatus as claimed in claim 10 wherein the retaining member includes a cover portion which overlies the facing side edge faces of the adjacent screen panels and the cover portion seats on the cantilever sections of the adjacent screen panels such that the upper surface of the cover portion lies flush with the upper surfaces of the adjacent screen panels to prevent ore fines from entering between said facing side edge faces.

17. Screening apparatus as claimed in claim 5 wherein each upwardly directed arm has a height which is less than the height of an adjacent side face of a screen panel, and wherein the retaining member includes a cover portion which overlies the facing side edge faces of adjacent screen panels to prevent ore fines from entering the joint and the cover portion seats on the upper facing ends of the arms and adjacent surfaces of the screen panels such that the upper surface of the cover portion lies flush with the upper surfaces of the adjacent screen panels.

18. A screen panel for use in a screening apparatus wherein an elongate side edge face of the panel includes a longitudinally extending connection portion for clamping between an elongate fixing member and an elongate retaining member, wherein the connection portion comprises a connection arm which is connected to the side edge face by a cantilever section, the connection arm extending from the cantilever section in a direction that is substantially transverse of the elongate fixing member, and wherein the screen panel is such that said retaining member is engageable therewith to effect said clamping of said connection portion.

* * * * *